US006583404B1

(12) United States Patent
Sakurai

(10) Patent No.: US 6,583,404 B1
(45) Date of Patent: Jun. 24, 2003

(54) PHOTOELECTRIC SMOKE DETECTING APPARATUS

(75) Inventor: Shigeru Sakurai, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 24 days.

(21) Appl. No.: 09/708,429

(22) Filed: Nov. 9, 2000

(30) Foreign Application Priority Data

Nov. 10, 1999 (JP) ..... 11-319746

(51) Int. Cl.[7] ..... H01J 40/14

(52) U.S. Cl. ..... 250/222.2; 250/554; 356/337; 356/338

(58) Field of Search ..... 250/222.2, 221, 250/554; 340/577, 632; 356/337, 338, 437, 438

(56) References Cited

U.S. PATENT DOCUMENTS

| | | | | |
|---|---|---|---|---|
| 4,618,853 A | * | 10/1986 | Yuchi | 340/505 |
| 4,930,095 A | * | 5/1990 | Yuchi et al. | 702/87 |
| 5,546,074 A | | 8/1996 | Bernal et al. | 340/628 |
| 5,798,701 A | | 8/1998 | Bernal et al. | 340/628 |
| 5,966,077 A | | 10/1999 | Wong | 340/630 |

* cited by examiner

*Primary Examiner*—Robert H. Kim
*Assistant Examiner*—Courtney Thomas
(74) *Attorney, Agent, or Firm*—Wenderoth, Lind & Ponack, L.L.P.

(57) ABSTRACT

A photoelectric smoke detecting apparatus capable of generating analog data accurately indicating a smoke density regardless of a presence or absence of contamination. A control unit for outputting the analog data corresponding to the smoke density based on a detection value derived from the output of a smoke sensor includes a smoke density arithmetic module having a characteristic function for converting the detection value to a smoke density value, a zero-density detection value storage device for storing a detection value at a time point when the smoke density is zero as a zero-density detection value, a change ratio arithmetic module designed for arithmetically determining a ratio of change representing a change of the zero-density detection value, and a compensation arithmetic module designed for compensating conversion characteristic for converting the detection value to the smoke density value based on the ratio of change. The compensation arithmetic module is designed to cause the smoke density arithmetic module to generate the smoke density value in such a manner to counter a change of an output characteristic of the detection value for of the smoke density, which change depends on the ratio of change. A self- or auto-compensation function against aged deterioration of the detection value due to contamination is realized.

21 Claims, 10 Drawing Sheets

Yd: CHARACTERISTIC FUNCTION
Y0: INITIAL CHARACTERISTIC FUNCTION

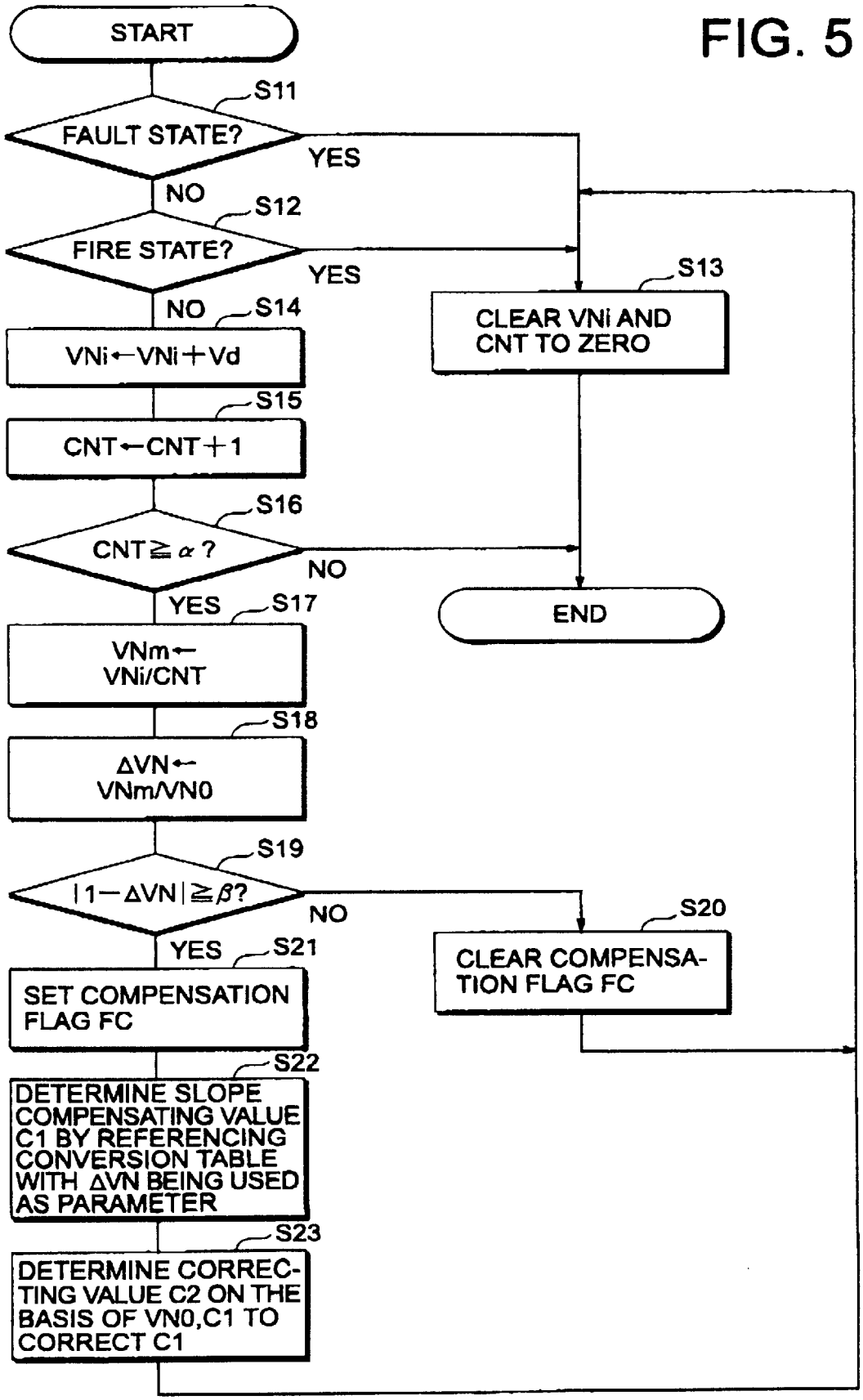
FIG. 5
START
S11
FAULT STATE?
YES
NO
S12
FIRE STATE?
YES
NO
S13
CLEAR VNi AND CNT TO ZERO
S14
VNi←VNi+Vd
S15
CNT←CNT+1
S16
CNT≧α?
NO
YES
END
S17
VNm← VNi/CNT
S18
ΔVN← VNm/VN0
S19
|1−ΔVN|≧β?
NO
YES
S20
CLEAR COMPENSATION FLAG FC
S21
SET COMPENSATION FLAG FC
S22
DETERMINE SLOPE COMPENSATING VALUE C1 BY REFERENCING CONVERSION TABLE WITH ΔVN BEING USED AS PARAMETER
S23
DETERMINE CORRECTING VALUE C2 ON THE BASIS OF VN0,C1 TO CORRECT C1

20
CONTROL UNIT
21
DRIVING CIRCUIT
22
A/D CONVER-TER
Dd
SMOKE CENSITY ARITHMETIC MODULE
CHARACTERISTIC FUNCTION TABLE
23
23T
Vke
24
TRANSMISS-ION CIRCUIT
E
30
RECEIVER EQUIPMENT
D
P
10
11
LIGHT EMITTING ELEMENT
12
LIGHT RECEIVING ELEMENT
13
L1
L2
14
14 : LABYRINTH INNER WALL

PHOTOELECTRIC SMOKE DETECTING APPARATUS

BACKGROUND OF THE INVENTION

1. Field of the Invention

The present invention generally relates to a photoelectric smoke detecting apparatus (also known as the smoke detector) for generating analog data concerning smoke density indicating occurrence of fire or the like event with the aid of a microcomputer or microprocessor. More particularly, the present invention is concerned with a photoelectric smoke detecting apparatus which is imparted with a self- or auto-compensation capability of automatically or spontaneously compensating for a time-dependent change or aged deterioration of a detection characteristic (light reception sensitivity) of a light receiving element incorporated in a smoke sensor of the smoke detecting apparatus due to contamination thereof.

2. Description of Related Art

Heretofore, a well known type of photoelectric smoke detecting apparatus is arranged such that a light emitting element is disposed within a well-ventilated chamber of a smoke sensor and is electrically driven periodically at a predetermined time interval for enabling a microcomputer or microprocessor to fetch the detection signal from the output of the smoke sensor thereby processing the same in order to decide whether a fire event is taking place in a place where the smoke sensor is installed or to detect the density of smoke prevailing in that place.

More specifically, the detection signal outputted from the light receiving element of the smoke sensor disposed for receiving light rays scattered by smoke particles is amplified by an amplifier circuit provided in association with the smoke sensor. The amplified signal is supplied to a microcomputer or microprocessor after analog-to-digital conversion (A/D conversion), whereon the digital data as fetched by the microcomputer is converted to corresponding smoke density data, which is then sent out in the form of an analog data signal to receiver equipment installed at a center station.

In the photoelectric smoke detecting apparatus of this type, contamination of an inner wall of a casing, a light emitting element and/or the light receiving element which constitute the smoke sensor will bring about a variation or change in the sensitivity characteristic of the smoke sensor and hence a change in the detection signal level which of course depends on the color of a contaminant.

Thus, when the contamination of the smoke sensor is detected, there arises the necessity of cleaning the sensor in order to restore the original state thereof to thereby prevent erroneous or false detection of the fire state. When such cleaning is difficult or practically impossible for some reason, it will then be required to take other appropriate measures such as exchange of the smoke sensor itself.

For having better understanding of the concept underlying the present invention, description will first be directed to the conventional photoelectric smoke detecting apparatus known heretofore by reference to FIGS. 6 and 7 of the accompanying drawings. FIG. 6 is a functional block diagram showing schematically a structure of a conventional photoelectric smoke detecting apparatus, whereas FIG. 7 is a circuit diagram of the same.

Referring to FIG. 6, the conventional photoelectric smoke detecting apparatus includes a smoke sensor 10 which is composed of a light emitting element 11 and a light receiving element 12. A shielding plate 13 is interposed between the light emitting element 11 and the light receiving element 12. It is noted that the light emitting element 11, the light receiving element 12 and the shielding plate 13 are disposed within a chamber enclosed by a labyrinth inner wall 14 which is employed for implementing the smoke sensor in an antireflection structure. By virtue of this structure, the light receiving element 12 can receive only the scattered light rays L2 of the light rays L1 emitted by the light emitting element 11, whereby the detection value D indicating the smoke density within the chamber enclosed by the labyrinth inner wall 14 can be acquired in the form of a detection signal outputted from the smoke sensor 10.

A control unit 20 which may be constituted by a microcomputer or microprocessor is designed or programmed to process the detection signal D outputted from the smoke sensor 10 to thereby output an analog data signal E indicative of the smoke density prevailing within the smoke sensor 10. At this juncture, it should be mentioned that a plurality of photoelectric smoke detecting apparatuses each composed of the smoke sensor 10 and the control unit 20 may be disposed at various locations within a building or the like where the smoke detection is required.

The output data signals (analog data signals E) of the individual photoelectric smoke detecting apparatuses installed at various places are supplied to receiver equipment 30 installed at a center station through signal transmission via signal lines (not shown).

As can be seen in FIG. 6, the control unit 20 includes a driving circuit 21 for generating a driving pulse signal P for driving the light emitting element 11, and A/D (analog to digital) converter 22 for converting the detection value D into digital data Dd and a smoke density arithmetic module 23 for determining arithmetically a smoke density value VKe on the basis of the digital data Dd by referencing a characteristic function table 23T incorporated in the smoke density arithmetic module 23. The control unit 20 is provided with a sender or transmission circuit 24 for sending or transmitting the smoke density value VKe in the form of an analog data signal E to the receiver equipment 30 of the center station.

In the characteristic function table 23T, there are stored characteristic functions each approximated by a positive linear function (represented by a straight line), as described later on.

Next, description will be made by reference to FIG. 7 in which reference characters 10 to 13, 20, L1 and L2 denote same items as those described above by reference to FIG. 6.

Referring To FIG. 7, the microcomputer 40 constituting a major part of the control unit 20 includes a CPU (Central Processing Unit) which serves for the functions of the A/D converter 22 and the smoke density arithmetic module 23 shown in FIG. 6 and other peripheral components. A light emitting circuit 41 corresponds to the driving circuit 21 shown in FIG. 6 and serves for electric power supply to the light emitting element 11 as well as pulse-like light emission control thereof. A light receiving circuit 42 is electrically connected to the light receiving element 12, and an amplifier circuit 43 is connected to the output of the light receiving circuit 42 for amplifying the detection signal, the amplified detection signal being then inputted to the microcomputer 40.

An oscillator circuit 44 is provided for supplying a clock pulse signal CK to the microcomputer 40. Further provided is an EEPROM (Electrically Erasable Programmable Read-Only Memory) 45 which is connected to the microcomputer 40 for storing preset data such as addresses and others.

An alarm lamp 46 is provided as an alarming means for generating an alarm upon occurrence of abnormality such as a fire. The alarm lamp 46 is driven or electrically energized by a lighting circuit 47 under the control of the microcomputer 40.

A receiving circuit 48 serves for receiving signals such as external signals sent from the receiver equipment 30 (see FIG. 6), which signal are then inputted to the microcomputer 40. On the other hand, the output signals of the microcomputer 40 are sent to external apparatus via a transmitting circuit 49. Incidentally, the receiving circuit 48 and the transmitting circuit 49 functionally correspond to the transmission circuit 24 shown in FIG. 6.

A constant-voltage circuit 50 is provided for supplying electric power to the microcomputer 40 and others incorporated in the control unit 20 and other discrete circuits 41 to 49.

A diode bridge circuit 51 serves for nullifying the poralities of terminals when the control unit 20 and the receiver equipment 30 of the center station (see FIG. 6) are interconnected by a signal line (not shown).

FIG. 8 is a signal waveform diagram for illustrating detection levels or pulses outputted from the light receiving element 12 in correspondence to the driving pulses P, respectively, in the state where the smoke density is zero when the driving pulses P are applied to the light emitting element 11.

As can be seen in FIG. 8, a train of driving pulses P includes first pulses PI for fire detection and a second pulse P2 for fault detection, wherein the second pulse P2 is at a higher level than the first pulse P1.

At this juncture, it should be mentioned that the second pulse P2 serves for the function for increasing or intensifying the light emission of the light emitting element 11 in addition to the function of the first pulse P1. As the alternative, the second pulse P2 may be generated by increasing intermittently the amplification factor of the amplifier circuit 43 connected to the output of the light receiving circuit 42.

The output period or cycle $\tau$ of the first pulses P1 and the second pulses P2 is set at an equi-interval (e.g. two seconds), wherein the second pulse P2 for fault detection is generated once for four pulses (e.g. at the interval of eight seconds).

With the conventional photoelectric smoke detecting apparatus of the structure described above by reference to FIGS. 6 and 7, the smoke sensor 10 is driven in response to the driving pulse train P illustrated in FIG. 8, whereby emission of light rays L1 and reception of the scattered light rays L2 are carried out repetitively, as a result of which the detection value D is outputted from the light receiving element 12.

On the other hand, the control unit 20 fetches the detection value D through the medium of the light receiving circuit 42, the amplifier circuit 43 and the A/D converter 22 to thereby generate the analog data E indicative of the smoke density in accordance with the characteristic function table 23T, the analog data signal E as generated being then sent to the receiver equipment 30 via the transmitting circuit 49 as shown in FIG. 7 (corresponding to the transmission circuit shown in FIG. 6).

Since the second pulse P2 is contained in the driving pulse train P, the light emitting element 11 emits the light rays L1 at a higher output level once for eight seconds. In response to the emitted light rays L1 of the high intensity, the light receiving element 12 outputs the detection value D which can be used for detecting the noise level internally of the smoke sensor 10.

At this juncture, it should be added that the characteristic function stored in the characteristic function table 23T remains unchanged in the initial state without being corrected even when the characteristic function of the smoke sensor 10 has changed.

According to the International Standards FDK38U as well as the Japanese Standards FDK038-X, it is recommended that the fire detection or fault detection be performed at the output period $\tau$ of about two seconds and that the fault detection be performed once for four cycles (i.e., periodically at an interval of about eight seconds).

As is apparent from the foregoing description, in the photoelectric smoke detecting apparatus known heretofore, no compensating measures are taken or adopted against the change of the detection level. Consequently, when the characteristic function of the smoke sensor has changed, the analog data E indicating accurately the smoke density can no more be made available, giving rise to a problem that the fire state can not be determined with reasonable accuracy and reliability in the center station equipped with the receiver equipment 30.

SUMMARY OF THE INVENTION

In the light of the state of the art described above, it is an object of the present invention to provide a photoelectric smoke detecting apparatus which is capable of making available the analog data signal indicating accurately the smoke density regardless of contamination of the smoke sensor by imparting to the photoelectric smoke detecting apparatus the function or capability for automatically or spontaneously compensating the time-dependent change of the detection value derived from the output of the light receiving element of the smoke sensor due to the contamination thereof.

In view of the above and other objects which will become apparent as the description proceeds, there is provided according to a general aspect of the present invention a photoelectric smoke detecting apparatus which includes a smoke sensor composed of a light emitting element and a light receiving element accommodated within a chamber enclosed by a labyrinth inner wall for outputting from the light receiving element a detection signal indicative of a detection value corresponding to a smoke density prevailing within the chamber enclosed by the labyrinth inner wall. The smoke detecting apparatus further includes a control unit for outputting analog data corresponding to the smoke density on the basis of the detection value. The control unit is comprised of a smoke arithmetic module having a characteristic function for converting the detection value to a smoke density value, a zero-density detection value storage device for storing a detection value at a time point when the smoke density is zero as a zero-density detection value, a change rate (i.e. ratio) arithmetic module designated for determining arithmetically a ratio of change (also referred to as the change ratio) of the zero-density detection value, and a compensation arithmetic module designed for compensating conversion characteristic for converting the detection value to the smoke density value by taking into account the above-mentioned ratio of change. Further, the compensation arithmetic module is designed as cause the smoke density arithmetic module to generate a smoke density value in such a manner that change of output characteristic of the detection value for the smoke density, which change bears dependency on ratio of the change, can be canceled out.

In a preferred mode for carrying out the present invention, the change ratio arithmetic module may be designed to arithmetically determine the change ratio as a value derived by dividing the zero-density detection value by an initial value thereof, wherein the compensation arithmetic module is so designed as to correctively increase the detection value as the change ratio of the zero-density detection value increases or alternatively decreases from a value "1 (one)".

In another mode for carrying out the present invention, the change ratio arithmetic module should preferably be designed to arithmetically determine the change ratio in terms of an absolute value derived from division of a change quantity of the zero-density detection value from the initial zero-density detection value by the initial value, wherein the compensation arithmetic module is so designed as to correctively increase the detection value in dependence on increasing of the change ratio of the zero-density detection value.

In yet another mode for carrying out the present invention, the compensation arithmetic module should preferably be so designed as to correct the detection value in dependence on the change ratio and establish a detection value after compensation by adding or, alternatively, subtracting the change quantity of the zero-density detection value.

In still another mode for carrying out the present invention, the change ratio arithmetic module should preferable be designed to arithmetically determine the change ratio as a value derived by dividing the zero-density detection value by an initial value thereof, wherein the compensation arithmetic module is designed to correctively establish a slope of the currently valid characteristic function to be smaller than an initial slope thereof as the change ratio increases or alternatively decreases from a value "1 (one)".

In a further mode for carrying out the present invention, the change ratio arithmetic module should preferably be designed to arithmetically determine the change ratio in terms of an absolute value derived from division of a change quantity of the zero-density detection value from the initial zero-density detection value by this initial value, wherein the compensation arithmetic module is designed to correctively establish a slope of the currently valid characteristic function to be smaller than an initial slope thereof in dependence on increasing of the change ratio.

In a yet further mode for carrying out the present invention, the compensation arithmetic module should preferably be designed to correct the slope of the characteristic function in dependence on the change ratio and establish a characteristic function after compensation by adding to or, alternatively, subtracting from the zero-density detection value the change quantity of the zero-density detection value.

In a still further preferred mode for carrying out the present invention, the control unit may include an analog-to-digital converter for converting the detection value to digital data, wherein the smoke density arithmetic module is designed to convert the digital data to the smoke density value.

In another preferred mode for carrying out the present invention, the compensation arithmetic module-may include a compensation range discriminating means for deciding whether the change ratio falls within a predetermined range for compensation and generating fault information when the change ratio departs from the predetermined range for compensation.

In yet another mode for carrying out the present invention, the compensation arithmetic module should preferably be designed that when a state in which the change ratio falls within the predetermined range for compensation has continued for a predetermined time duration, a value derived through average processing of the zero-density detection value over the predetermined time duration is employed as a final change ratio.

In still another preferred mode for carrying out the present invention, the compensation arithmetic module may include a compensating value setting module for fixedly placing therein a compensating value which corresponds to the change ratio.

In a further mode for carrying out the present invention, the compensation arithmetic module may preferably include a correcting value setting means for establishing a correcting value for correcting the compensating value in dependence on the zero-density detection value.

In a yet further mode for carrying out the present invention, the correcting value setting means may preferably include a correcting value storing means for storing the correcting value, wherein the correcting value can externally altered through input manipulation.

By virtue of the arrangements described above, there can be implemented a photoelectric smoke detecting apparatus which is capable of generating analog data which accurately indicates the smoke density regardless of contamination of the smoke sensor owing to the feature of self- or auto-compensation for aged deterioration or time-dependent change of the detection value outputted from the light receiving element of the smoke sensor due to contamination thereof The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIG. 5 is a flow chart for illustrating a processing procedure executed upon detection of fault in the photoelectric smoke detecting apparatus according to the first embodiment of the invention.

DESCRIPTION OF THE PREFERRED EMBODIMENTS

Figure 1:
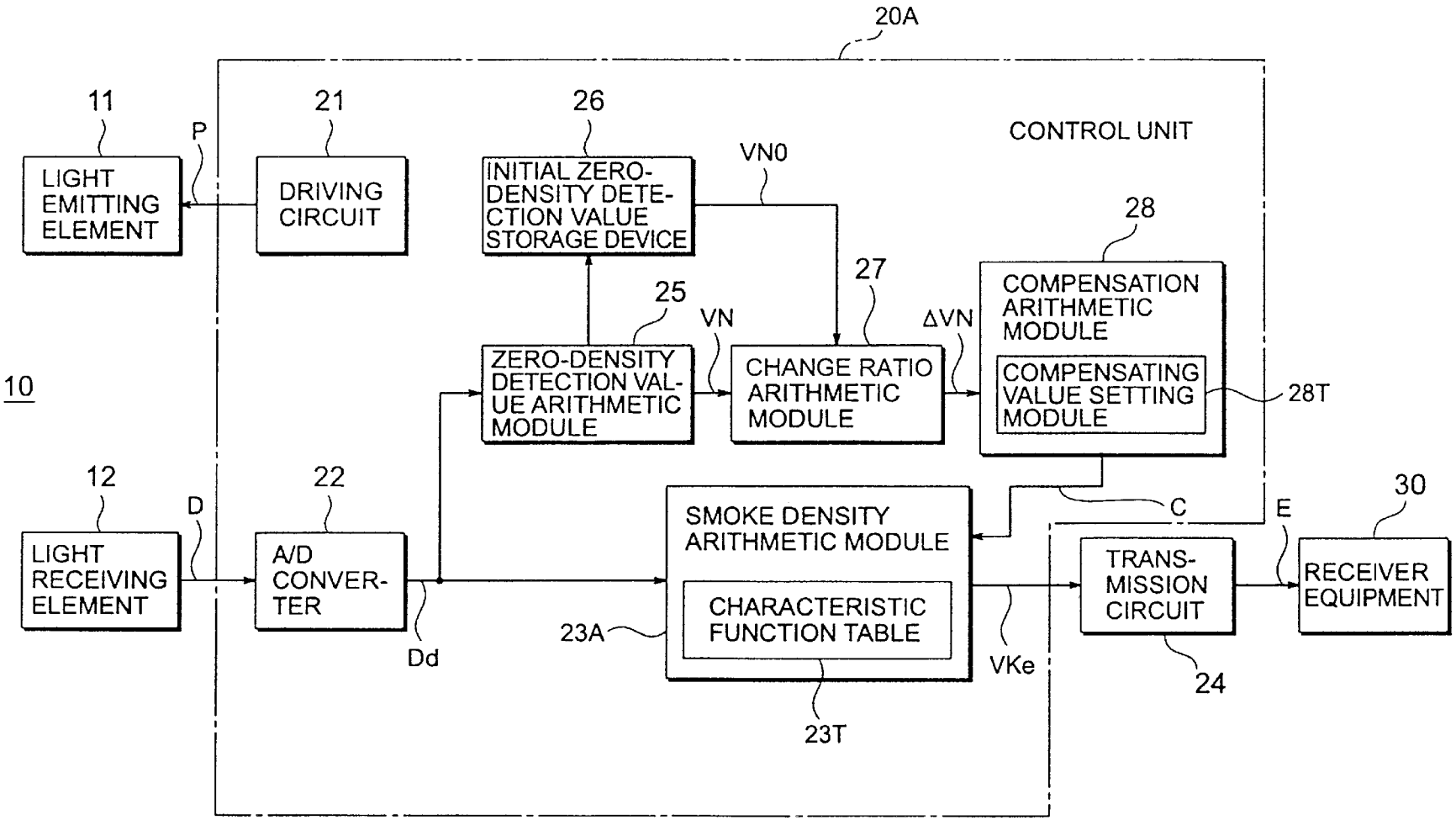
FIG. 1 is a functional block diagram schematically showing a structure of a photoelectric smoke detecting apparatus according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

Figure 6:
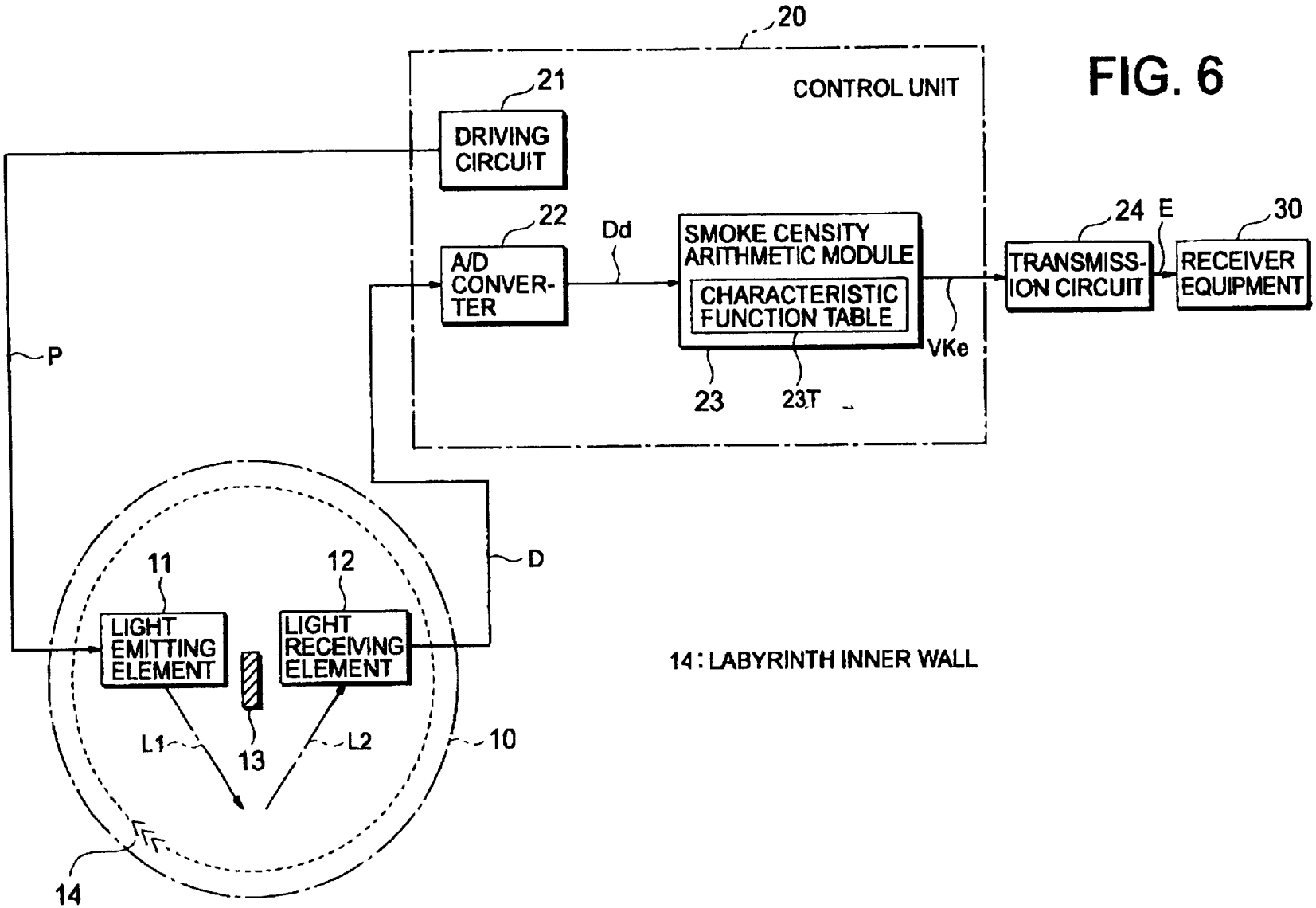
FIG. 6 is a functional block diagram schematically showing a structure of a conventional photoelectric smoke detecting apparatus.

FIG. 1 is a functional block diagram showing schematically a structure of the photoelectric smoke detecting apparatus according to a first embodiment of the present invention. In the figure, items similar to those described hereinbefore (see FIG. 6) are denoted by like reference characters with the equivalent being designated by like reference numerals affixed with "A", and detailed description thereof is omitted.

Figure 7:
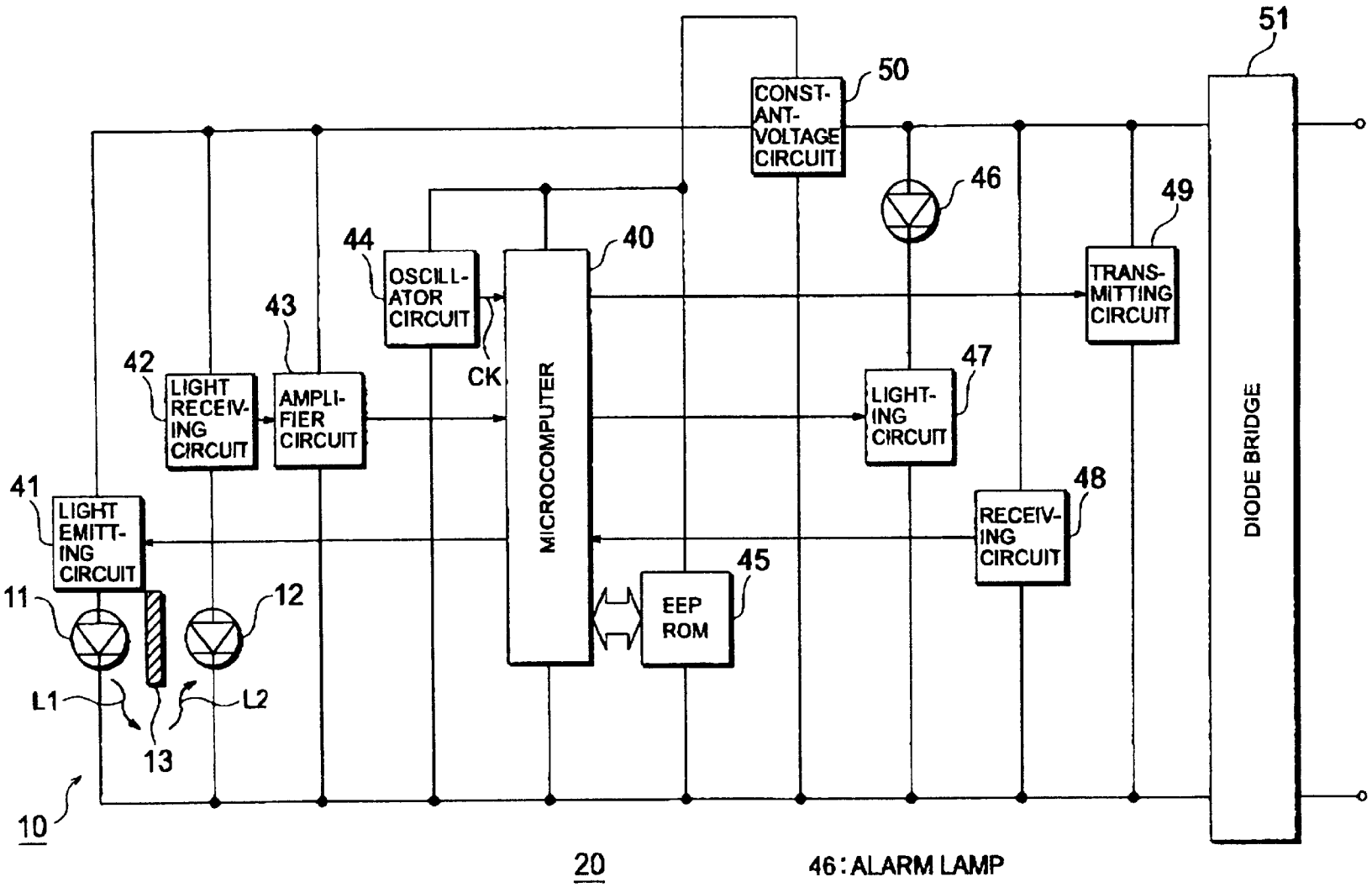
FIG. 7 is a circuit diagram schematically showing a circuit arrangement of the same.

It should first be mentioned that the arrangement of the photoelectric smoke detecting apparatus which is omitted from illustration in FIG. 1 is substantially same as that described hereinbefore, and that the circuit arrangement shown in FIG. 7 is also adopted in the photoelectric smoke detecting apparatus according to the instant embodiment of the invention.

Figure 8:
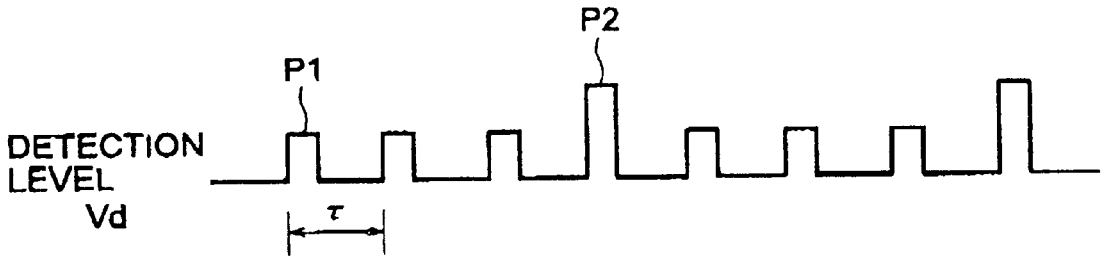
FIG. 8 is a waveform diagram for illustrating detection levels or pulses outputted from a light receiving element of a smoke sensor in response to driving pulses.

Further, the timing at which the driving pulses P are applied to the light emitting element 11 is substantially same as the one illustrated in FIG. 8. Changes of the characteristic function of the smoke sensor 10 due to contamination will be described later on by reference to FIGS. 9 to 13.

Referring to FIG. 1, in the photoelectric smoke detecting apparatus according to the first embodiment of the invention, the control unit designed by 20A in the instant case includes in addition to the driving circuit 21, the A/D converter 22, the smoke density arithmetic module 23A and the transmission circuit 24 described previously in conjunction with the related art a zero-density detection value arithmetic module 25, an initial zero-density detection value storage device 26, a change ratio arithmetic module 27, and a compensation arithmetic module 28.

The zero-density detection value arithmetic module 25 is designed or programmed to arithmetically determine the detection value when the smoke density Ke is zero as a zero-density detection value VN on the basis of the digital data Dd of the detection value D outputted from the light receiving element 12 in response to the second pulse P2 (see FIG. 8). On the other hand, the initial zero-density detection value storage device 26 is employed for storing the initial value of the zero-density detection value VN (i.e., the value before the smoke sensor 10 undergoes contamination) as the initial zero-density detection value VNO.

The ratio module 27 is designed or programmed to arithmetically determine, on the basis of the zero-density detection value VN and the initial zero-density detection value VNO, a ratio between the zero-density detection value VN and the initial zero-density detection value VNO (i.e., VN/VNO) or an absolute value acquired by dividing (or normnalizing) magnitude of the change (hereinafter also referred to as the change quantity) of the zero-density detection value VN from the initial zero-density detection value VNO by the initial value VNO (i.e., |(VN−VNO)/VNO|) as the ratio of change, (also referred to as the change ratio) ΔVN of the zero-density detection value.

The compensation arithmetic module 28 is designed or programmed to arithmetically determine a compensating value C for compensating the characteristic of conversion of the digital data Dd of the detection value D to the smoke density value VKe on the basis of the ratio or change ratio ΔVN.

Figure 11:
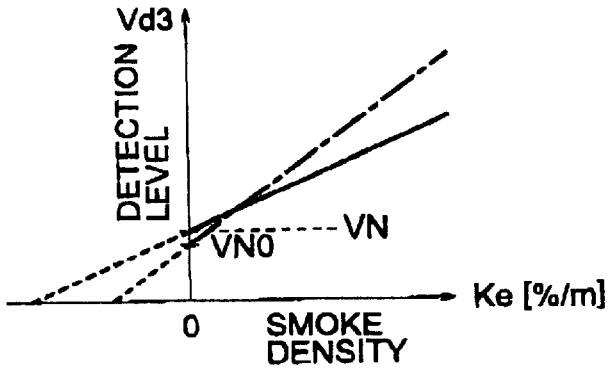
FIG. 11 is a view for illustrating change of a detection level for a smoke density in the state where a whole optical system of a smoke sensor has been contaminated in white.
Figure 13:
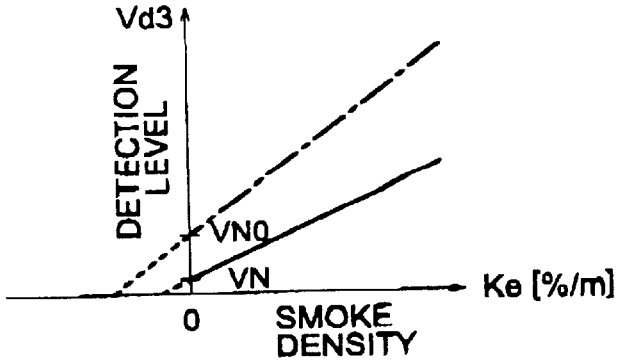
FIG. 13 is a view for illustrating change of a characteristic function of a detection level for a smoke density in the state where a whole optical system of a smoke sensor has been contaminated in black.

The compensating value C determined arithmetically by the compensation arithmetic module 28 is inputted to the smoke density arithmetic module 23A which responds thereto by generating the smoke density value VKe such that change in the output characteristic of the detection value D for the smoke density Ke, which change corresponds to the change ratio ΔVN, can be canceled out (see FIGS. 11 and 13). More specifically, the compensation arithmetic module 28 generates the compensating value C which correctively increases the digital data Dd of the detection value D correspondingly as the change ratio ΔVN of the zero-density detection value increases. To this end, the compensation arithmetic module 28 incorporates therein a compensating value setting module 28T for storing fixedly the compensating values C corresponding to the change ratios ΔVN, respectively.

At this juncture, description will be made in detail of the change of the sensitivity characteristic of the smoke sensor. At first, tendency patterns of contamination will be discussed by referring to FIGS. 9 to 13 which illustrate tendencies of changes of the characteristic function in the level Vd of the detection value signal D (detection level) for the smoke density Ke [%/m] on a patten-by-pattern basis.

Figure 9:
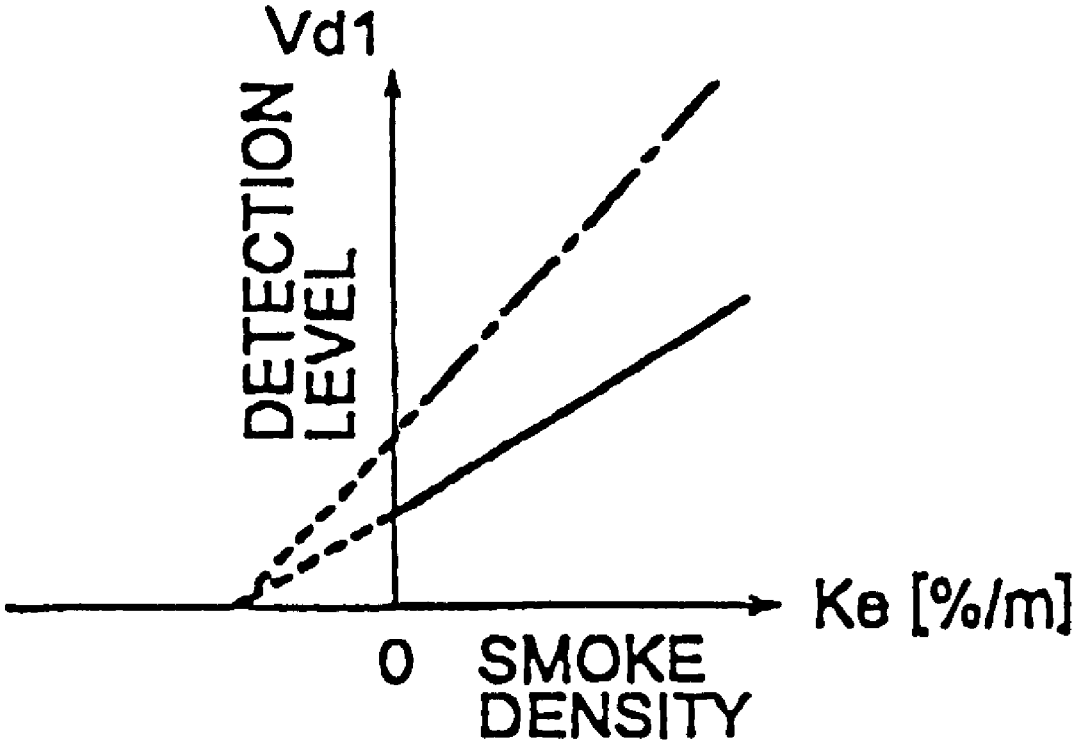
FIG. 9 is a view for illustrating change of a characteristic function of a detection level for a smoke density in the state where a light emitting element and/or a light receiving element of the smoke sensor has been contaminated.

FIG. 9 is a view showing a tendency of the change of the detection level Vd1 in the case where surfaces (lenses) of the light emitting element 11 and the light receiving element 12 are contaminated with a material or substance in white or black.

Figure 10:
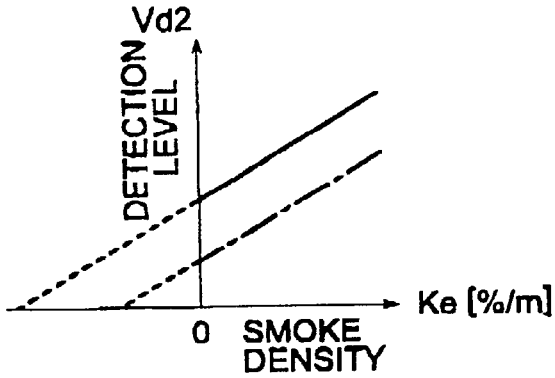
FIG. 10 is a view for illustrating change of a characteristic function of a detection level for the smoke density in the state where a labyrinth inner wall has been contaminated in white.

Further, FIG. 10 shows a tendency of the change of the detection level Vd2 in the case where the labyrinth inner wall 14 is contaminated with a white material, while FIG. 11 is a view showing a tendency of the change of the detection level Vd3 in the case where the whole smoke sensor 10 (the light emitting and light receiving elements 11 and 12 and the labyrinth inner wall 14) is contaminated with a white material. Parenthetically, the tendency of the change of the detection level Vd3 illustrated in FIG. 11 can be approximated through synthesization of the characteristics illustrated in FIGS. 9 and 10, respectively.

Figure 12:
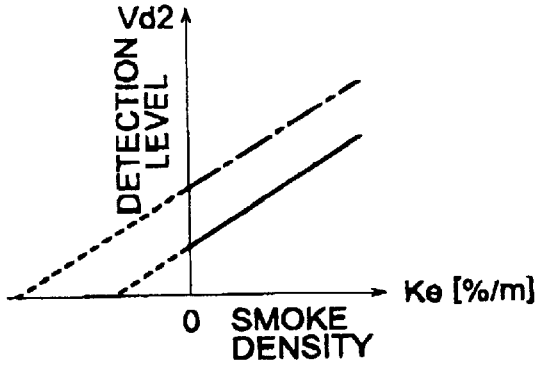
FIG. 12 is a view for illustrating change of a detection level for a smoke density in the state where a labyrinth inner wall of the smoke sensor has been contaminated in black.

Furthermore, FIG. 12 shows a tendency of the change of the detection level Vd2 in the case where the labyrinth inner wall 14 is contaminated with a black material, while FIG. 13 is a view showing a tendency of the change of the detection level Vd3 in the case where the smoke sensor 10 as a whole is contaminated with a black material. Parenthetically, the tendency of the change of the detection level Vd3 illustrated in FIG. 13 can be approximated through synthesization of the characteristics illustrated in FIGS. 9 and 12, respectively.

In each of FIGS. 9 to 13, a single-dotted broken line represents the initial characteristic function (i.e., characteristic function before being contaminated), and a solid line represents the characteristic function after contamination, wherein each of the characteristic functions is approximated by a linear function of a positive slope. Furthermore, in each of these figures, the characteristic function within a negative or minus range of the smoke density Ke which is not practically used for the data conversion is indicated by a broken line only for convenience of illustration for indicating the straight line representing the characteristic function as a whole.

Now, reference will first be made to FIG. 9. As can easily be appreciated, the transmission quantity of light decreases at a predetermined rate as the contamination of the light emitting element 11 and the light receiving element 12 makes progress. Consequently, the slope (detection sensitivity of the sensor) of the straight line (solid line) representing the characteristic function of the detection level Vd1 after contamination becomes more gentle when compared with that of the characteristic function before the contamination represented by the single-dotted broken line regardless of the color of the contaminant.

On the other hand, in the case illustrated in FIG. 10, the reflection quantity of light (i.e., quantity of light reflected by the labyrinth inner wall 14) which may also be referred to as the noise level increases by a predetermined value due to white contamination of the labyrinth inner wall 14. As a result of this, the characteristic function of the detection level Vd2 after contamination as represented by a solid line is shifted in the direction in which the detection level increases when compared with the characteristic function in the state not contaminated (represented by a single-dotted broken line).

Further in the case illustrated in Fig. 11, the characteristic function of the detection level Vd3 after contamination represented by a solid line is shifted in the direction in which the detection level increases although the characteristic function after contamination exhibits a gentle slope as compared with the characteristic function in the state not contaminated as represented by a single-dotted broken line. Consequently, the level VN (zero-density detection value) for the smoke density Ke of zero increases beyond the initial zero-density detection value VNO.

By contrast, in the case illustrated in FIG. 12, the reflection quantity of light (noise level) decreases by a predetermined value due to black contamination of the labyrinth inner wall 14, the characteristic function of the detection level Vd2 after contamination as represented by a solid line is shifted in the direction in which the detection level decreases when compared with the characteristic function in the state not contaminated (represented by a single-dotted broken line).

Finally, in the case illustrated in FIG. 13, the characteristic function of the detection level Vd3 after contamination (represented by a solid line) is shifted in the direction in which the detection level decreases after contamination and exhibits a gentle slope when compared with the characteristic function in the state not contaminated (represented by a single-dotted broken line). Consequently, the zero-density detection value VN decreases as compared with the initial zero-density detection value VNO.

Figure 2:
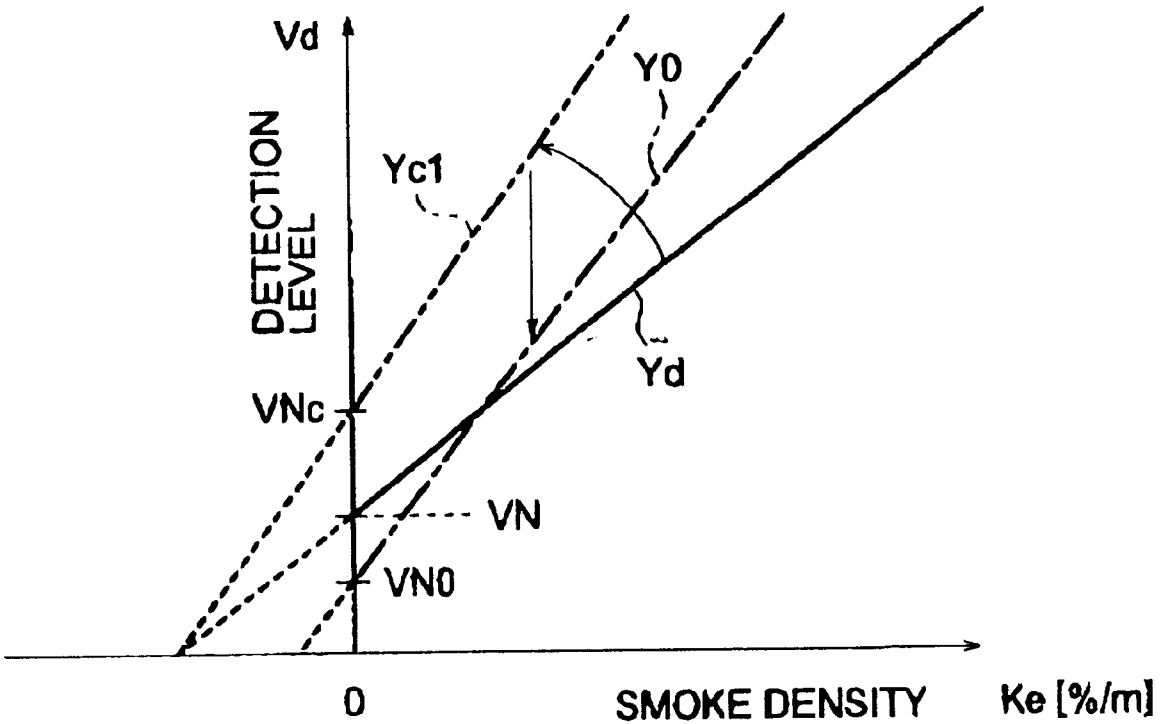
FIG. 2 is a view for illustrating changes of characteristic functions of detection values for smoke densities and a compensating arithmetic procedure according to the present invention.

FIG. 2 is a view for illustrating changes of the characteristic function of the level (detection level) Vd of the detection value D for the smoke density Ke [%/m] and a compensation arithmetic procedure on the presumption that the smoke sensor as a whole is contaminated with white material (corresponding to the case illustrated in FIG. 11).

Referring to FIG. 2, a single-dotted broken line YO represents a characteristic function before contamination (i.e., initial characteristic function) while a solid line Yd represents the characteristic function after the contamination (i.e., current characteristic function). Further, a double-dotted broken line Yc1 represents a characteristic function obtained after a slope compensation arithmetic operation or procedure. The double-dotted broken line Yc1 shows that the detection level Vd is correctively increased with a predetermined amplification factor which corresponds to the ratio of change (change ratio) ΔVN of the zero-density detection value VN.

As can be seen in FIG. 2, the slope of the characteristic function Yc1 undergone the slope compensation arithmetic procedure as represented by the double-dotted broken line coincides with the slope of the initial characteristic function YO (represented by the single-dotted broken line).

In practice, the difference between the zero-density detection value VNc of the characteristic function after the slope compensation arithmetic and the initial zero-density detection value VNO is canceled out through translation or parallel displacement procedure.

Figure 3:
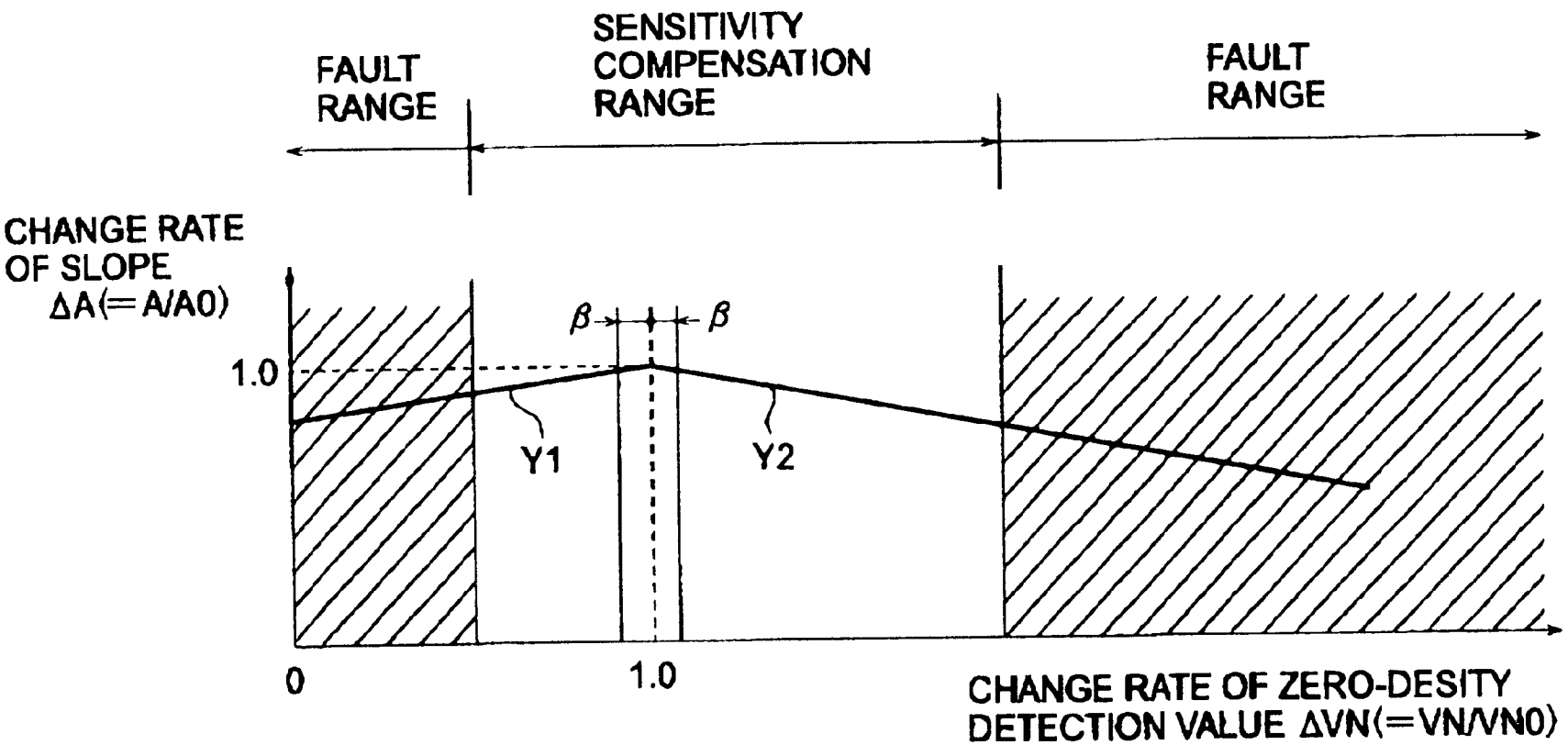
FIG. 3 is a characteristic diagram for graphically illustrating a relation between change ratio of a slope of a characteristic function and change ratio of a zero-density detection value in the photoelectric smoke detecting apparatus.

FIG. 3 is a characteristic diagram for illustrating graphically a relation between the change ratio ΔA of the slope of the characteristic function and the change ratio ΔVN of the zero-density detection value VN. For simplification of the arithmetic operation, the change ratio ΔVN of the zero-density detection value VN is defined as VN/VNO with the change ratio ΔA of the slope of the characteristic function being defined by A/AO (where AO represents the slope of the initial characteristic function and A represents the slope of the characteristic function after contamination).

As can be seen in FIG. 3, as the deviation of the change ratio ΔVN of the zero-density detection value VN from the initial value "1–0" (VN=VNO) increases or decreases, the change ratio ΔA of the slope A of the characteristic function after contamination decreases.

In FIG. 3, the change ratio ΔVN of the zero-density detection value VN is taken along the abscissa (x-axis) while the change ratio ΔA of the slope A is taken along the ordinate (y-axis). Further, the function of the change ratio ΔA of the slope A within a range given by $\Delta VN \leqq 1.0$ is represented by a solid line Y1, while the function of the change ratio ΔA of the slope A within a range given by $\Delta VN \geqq 1.0$ is represented by a solid line Y2. In that case, the functions Y1 and Y2 can be approximated with the undermentioned expressions (1) and (2), respectively.

$$Y1 = O.1X + 0.9 \quad (1)$$

$$Y2 = -O.1X + 1.1 \quad (2)$$

Further, as can be seen in FIG. 3, a region extending around the change ratio ΔVN of "1.0" is defined as a sensitivity compensation range, while regions departed relatively far from the change ratio ΔVN of "1.0" are defined as fault ranges, respectively, in which a fault decision procedure is executed separately from the sensitivity compensation procedure which is carried out within the sensitivity compensation range.

In this conjunction, it should be mentioned that a temporal factor is involved in the fault range discrimination procedure validated within the fault range although detailed description thereof is omitted. Upon decision or detection of fault of the smoke sensor 10, a relevant message is issued for prompting exchange of the smoke sensor 10 without carrying out the sensitivity compensation procedure.

It should further be added that the compensation arithmetic module 28 includes a fault range discriminating means for deciding whether the change ratio ΔVN falls within a predetermined range for compensation and generating fault information when the change ratio ΔVN departs from the predetermined range for sensitivity compensation (i.e., falls within the fault range), whereby a fault message is issued without carrying out the sensitivity compensation.

Next, referring to flow charts shown in FIGS. 4 and 5 together with FIGS. 2, 3, 7 to 13, operation of the photoelectric smoke detecting apparatus according to the first embodiment of the invention will be described.

Figure 4:
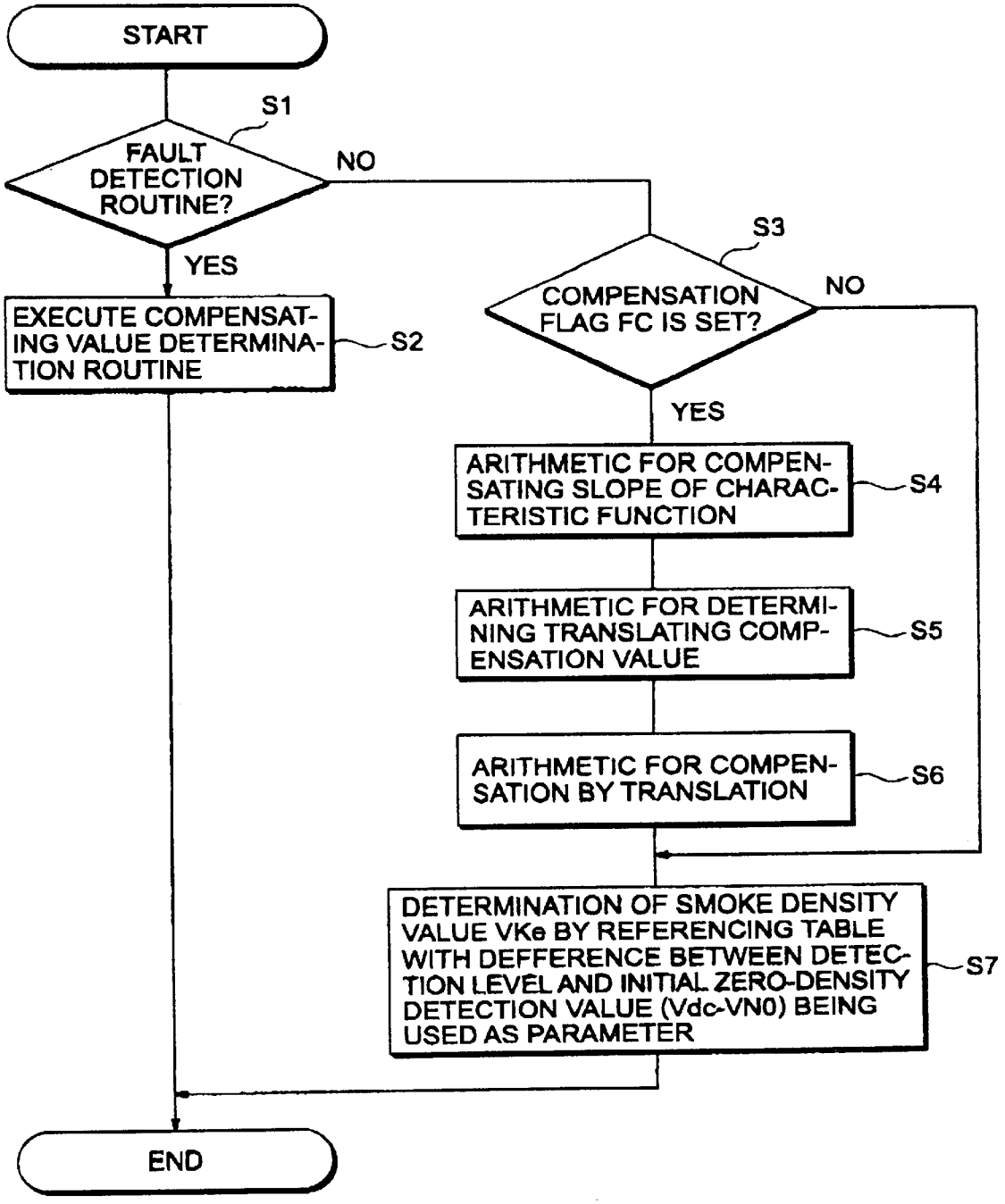
FIG. 4 is a flow chart for illustrating an ordinary smoke density detection procedure in the photoelectric smoke detecting apparatus according to the first embodiment of the present invention.

Referring to FIG. 4, it is first decided by the control unit 20A in a step S1 whether the fault detection procedure or routine is validated on the basis of the timing of the driving pulses P (see FIG. 8).

When it is determined in the step S1 that the fault decision routine is validated at the output timing of the second pulse P2 for the fault detection (i.e., when the decision step S1 results in affirmation "YES"), then a compensating value determining routine or procedure (see FIG. 5) is validated (step S2), whereon the routine illustrated in FIG. 4 comes to an end.

On the other hand, when it is determined in the step S1 that the fault detection routine is not to be validated (i.e., when the decision step S1 results in negation "NO"), this means that the first pulse P1 for the fire detection (see FIG. 8) is generated. Consequently, the microcomputer 40 constituting a major part of the control unit 20A (see FIG. 7) outputs the first pulse P1 to the light emitting circuit 41.

In response to the output of the light emitting circuit 41, the light emitting element 11 is electrically energized to emit light rays while the control unit 20A fetches the detection value D from the output of the light receiving element 12 via the A/D converter 22. In succession, the control unit 20A determines whether a compensation flag FC has been set (step S3).

When it is determined in the step S3 that the compensation flag has been set (i.e., when the decision step S3 results in affirmation "YES"), then the compensation arithmetic module 28 executes the slope compensation arithmetic operation for the characteristic function Yd such that the characteristic function Yd represented by the solid line in FIG. 2 is angularly shifted to the characteristic function Yc1 represented by the double-dotted broken line in the same figure (step S4).

In succession, the compensation arithmetic module 28 arithmetically determines the translating (or parallel displacing) compensation value (step S5) to thereby perform the translating compensation arithmetic operation so that the characteristic function Yc1 represented by the double-dotted broken line in FIG. 2 is parallel-shifted or translated to the characteristic function YO represented by the single-dotted broken line in the same figure (step S6).

In conjunction with the processing( step S4, it is supposed, by way of example, that the initial value VNO of the zero-density detection level of the photoelectric smoke detecting apparatus has already been set at the time point at which the sensitivity thereof was set in a manufacturing factor upon shipping therefrom. Then, the slope compensating value may be determined on the basis of the ratio of change ΔVN of the current zero-density detection value VN from the initial value VNO in the place where the photoelectric smoke detecting apparatus is installed, and then the slope or sensitivity compensation is performed for the current detection level Vd.

In this manner, the slope (sensitivity) of the characteristic function Yd (represented by the solid line) which has become more gentle due to contamination of the smoke sensor is so corrected that it coincides at least substantially with the slope of the initial characteristic function YO represented by the double-dotted broken line Yc1, as indicated by the double-dotted broken line Yc1.

In a step S5, the translating compensation value (parallel-displacement) is arithmetically determined on the basis of the initial zero-density detection value VNO and the slope compensating value (amplification factor) as determined.

In succession, in a step S6, the characteristic function Yc1 of the detection level Vd resulting from the slope compensation (as represented by the double-dotted broken line Yc1 in FIG. 2) is corrected by using the translating compensation value as determined. More specifically, the zero-density detection value VNc is shifted in the direction toward the origin (0) by the translating compensation value so that the current zero-density detection value VNc does actually coincide with the initial zero-density detection value VNO.

Through the procedure described above, the characteristic function of the digital data Dd based on the detection value D is corrected so that it coincides with the initial characteristic function (linear function). Thus, the conversion of the digital data Dd to the smoke density value VKe can be executed with very high accuracy on the basis of the initial characteristic function (linear function) by means of the smoke density arithmetic module 23A.

In this conjunction, it is presumed that the smoke density Ke is taken along the abscissa (x-axis), while the detection level Vd is taken along the ordinate (y-axis) as shown in FIG. 2. Then, the initial characteristic function YO represented by the single-dotted broken line in FIG. 2 as well as the characteristic function Yd after the contamination represented by the solid line in FIG. 2 can be approximated by the undermentioned expressions (3) and (4).

$$YO=AO\cdot X+VNO \tag{3}$$

$$Yd=A\cdot X+VN \tag{4}$$

where AO represents the slope of initial characteristic function, and A represents the slope of the post-contamination characteristic function.

On the other hand, the slope-compensated characteristic function Yc1 (double-dotted broken line) can be approximated by the following expression (5).

$$Yc1=AO\cdot X+VNc \tag{5}$$

Furthermore, the characteristic function Yc2 can be approximated by the above-mentioned expression (3) after the translating compensation. It will be seen that the characteristic function Yc2 coincides perfectly with the initial characteristic function YO after the translating or parallel-shifting compensation.

At this juncture, it should be mentioned that the initial zero-density detection value VNO (constant) represents the detection level (so-called noise level) in the state where no smoke exists and that the slope AO represents the sensitivity (ratio of change) of the detection level Vd in response to the change of the smoke density Ke.

In the processing routine illustrated in FIG. 4, the compensation processing steps S4 to S6 are executed when the zero-density detection value VN changes due to the so-called aged deterioration (i.e., deterioration as a function of time lapse) which may be regarded as being attributable to the contamination among others. In that case, the compensating value C is so selectively determined as to reduce the change ratio ΔVN.

The determined compensating value C is then used for determining a product with the value derived from subtraction or addition of the zero-density detection value VN from or to the detection value, whereon the conversion to the smoke density Ke is effectuated. Description which follows will be made on the assumption, by way of example only, that subtraction from the zero-density detection value VN is performed. In this case, a value which is obtained from a further correction is performed so that the initial characteristic function (straight line) passes through the origin.

More specifically, in the smoke density arithmetic module 23A, a value (Vdc−VNO) obtained from subtraction of the initial zero-density detection value VNO from the detection level Vdc in succession to the compensation arithmetic operation performed on the basis of the compensating value C (steps S4 to S6 in FIG. 4) is converted to the smoke density value VKe, by referencing the characteristic function table 23T (step S7).

The smoke density value VKe is then supplied to the transmission circuit 24 to be converted to the analog data signal E which is then sent or transmitted to the receiver equipment 30. Thus, the ordinary smoke density detection;, processing activated in response to the first pulse P1 comes to an end.

As is apparent from the above, the ordinary smoke density Ke is determined by dividing by the slope AO the value obtained by subtracting the zero-density detection value VNO from the detection level Vdc after compensation thereof (digital data level).

Next referring to FIG. 5, description will be directed to the compensating value determining routine (step S2 in the processing procedure illustrated in FIG. 4) which is executed when the driving pulse train P indicates the fault detection routine (i.e., the routine executed in response to the second pulse P2).

First in a step S11 shown in FIG. 5, decision is made whether the fault state is currently taking place. When it is decided that no fault occurs (i.e., when the decision step S11 results in negation "NO"), then decision is made as to occurrence of a fire (step S12).

When occurrence of the fault or the fire is decided in the step S11 or step S12 (i.e., when the decision step S11 or S12 results in "YES"), then the arithmetic operation for determining the compensating value C is skipped and the variables for arithmetically determining the compensating value such as accumulated zero-density detection value VNi and compensating counter value CNT are cleared to zero (step S13), whereupon the processing routine illustrated in FIG. 5 is terminated.

On the other hand, in the case where it is decided in the step S12 that no fire is taking place (i.e., when the decision step S12 results in "NO"), then the compensating value C is arithmetically determined. To this end, the accumulated zero-density detection value VNi is updated to a value added with the currently obtained detection level Vd (step S14) and the compensating counter value CNT is incremented (step S15).

Subsequently, decision is made in a step S16 whether the compensating counter value CNT has reached a value which corresponds to a standard update time period a (e.g. about 12 hours). When CNT<α (i.e., when the decision step S16 results in "NO"), then the processing routine illustrated in FIG. 5 is terminated.

By contrast, when it is decided in the step S16 that CNT≧α (i.e., when the step S16 results in "YES"), then a mean zero-density detection value VNm is determined on the basis of the accumulated zero-density detection value VNi and the compensating counter value CNT in accordance with the undermentioned expression (6) in a step S17.

$$VNm=VNi/CNT \tag{6}$$

In succession, the change ratio arithmetic module 27 determines the change ratio ΔVN on the basis of the mean zero-density detection value VNm and the initial zero-density detection value VNO in accordance with the undermentioned expression (7) (step S18).

$$\Delta VN=VNm/VNO \tag{7}$$

Subsequently, decision is made in a step S19 whether the absolute value of deviation of the change ratio ΔVN from the initial value (=1) thereof is equal to or greater than a reference value β for performing the compensation. When this decision step results in "NO", i.e., |1−ΔVN|<β, the compensation flag FC is cleared or reset in a step S20, whereon the step S13 is resumed.

By contrast, when the decision step S19 results in affirmation "YES" (i.e., when |1−ΔVN|≧β), the compensation flag FC is set to "1" in a step S21, which is then followed by a step S22 of determining a slope compensating value C1 on the basis of the change ratio ΔVN by referencing the conversion table stored in the compensation arithmetic module 28.

At this juncture, it should be mentioned that in the arithmetic processing step S18, the change ratio ΔVN of the zero-density detection value may be determined directly as the absolute value of the change ratio from the initial zero-density detection value VNO. In that case, the change ratio ΔVN can directly be compared with the reference value β.

In that case, by taking into account the relation between the change ratio ΔVN and the slope change ratio ΔA after contamination (i.e., linear proportional relation shown in FIG. 3), a corresponding table which allows the slope to be compensated straightforwardly may be prepared and stored in the ROM incorporated in the compensation arithmetic module 28 so that the slope compensating value C1 can selectively be determined simply by referencing the table.

At this juncture, it should also be added that although the reference value β for effectuating the compensation can be set arbitrarily, it is preferred to set the reference value β to a value very close to zero so that the compensation can be validated even for the change of a small magnitude.

Finally, a correction processing of the slope compensating value C1 (step S23) is executed in succession to the step S22 in consideration of the possibility that error is contained in the slope compensating value C1 determined on the basis of the change ratio ΔVN. Thereafter, the step S13 is resumed.

More specifically, in the step S23, a correcting value C2 for correcting further the slope compensating value C1 is determined for finely correcting the slope compensating value C1 on the basis of the initial zero-density detection value VNO and the slope compensating value C1, and the corrected slope compensating value C1 is established as the final sensitivity compensating value.

The correcting value C2 employed for finely adjusting the slope compensating value C1 may be set to an optimal value in advance through input operation with the aid of an external input device such as a keyboard and stored in the EEPROM incorporated in the compensation arithmetic module 28. Incidentally, it is to be mentioned that the correcting value C2 is a predetermined value which bears no relation to the change ratio ΔVN.

As mentioned above, the sensitivity compensating value determined from the change ratio ΔVN is stored in a memory incorporated in the compensation arithmetic module 28. Accordingly, at the succeeding detection timing corresponding to the succeeding first pulse P1, the smoke density value VKe can be determined with high accuracy and reliability on the basis of the compensated detection level Vdc.

In that case, the characteristic function Yc1 given by the expression (5) mentioned previously and undergone the slope compensation can be approximated in view of the expression (4) as follows:

$$Yc1=(A\cdot X+VN)\times C1\times C2 \tag{8}$$

In the expression (8), the zero-density detection value VN is certainly known from the mean zero-density detection value VNm. However, since the slope A after contamination (i.e., post-contamination slope A) is unknown, the characteristic function Yc1 is compensated for by making use of the slope compensating value C1 and the correcting value C2.

At this juncture, it should also be added that the slope AO and the initial zero-density detection value VNO appearing in the expression (3) mentioned hereinbefore are known from the initial characteristic and that the zero-density detection value VN appearing in the expression (4) is also known from the mean zero-density detection value VNm of the detection level Vd.

The characteristic function Yc1 given by the expression (8) is compensated through the translation processing described hereinbefore so that the condition that VN=VNO can be satisfied. However, in the characteristic function Yc2 after the translating compensation, it is only required that the value of VN×C1×C2 appearing in the expression (8) coincides with that of the initial zero-density detection value VNO. Thus, the expression (8) can be approximated by the following expression (9):

$$Yc2=Yc1+(VNO-VN\times C1\times C2) \tag{9}$$

In the above expression (9), the term VNO−VN×C1×C2 can be rewritten as follows:

$$VNO-VN\times C1\times C2=VNO\times(1-\Delta VN\times C1\times C2) \tag{10}$$

As is obvious from the above expression (10), all the parameters assume known values.

Through the compensation arithmetic procedure described above, the final straight line Yc2 after the sensitivity compensation can approximately be given by the undermentioned expression (11).

$$Yc2=(C1\times C2\times A)X+VNO \tag{11}$$

When the slope (C1×C2×A) appearing in the expression (11) satisfies the relation given by the following expression (12), this means that the compensation has been carried out so that coincidence with the initial characteristic is realized. Namely, $$C1\times C2\times A=AO \tag{12}$$

By the way, the update time period a for the slope compensating value C1 may be determined by two parameters K1 and K2 stored in the EEPROM. Presuming, by way of example, that K1=100 and K2=54, the update time period α is then 12 hours=8 (sec)×100×54=43200 seconds.

In general, the update time period α may variably be set within a range of 8 seconds to 520200 seconds or 144.5 hours (=8 sec.×255×255).

Similarly, the reference value β of the change ratio ΔVN for effectuating the sensitivity compensation may variably be set in dependence on a parameter K3 stored in the EEPROM. By way of example, when K3=95, the reference value β may be so set or selected that the sensitivity ation can be validated for the change ratio greater than 5%, i.e., when the change ratio ΔVN to or smaller than 95% (ΔVN≦95%).

The change ratio ΔVN can variably be set within a range of zero to 100%. The various parameter values mentioned above can be stored in the EEPROM.

Furthermore, as is apparent from the steps S11 to S13 shown in FIG. 5, the processing for updating the slope compensating value C1 is not executed in the fault state where breakage, deviation from the upper/lower limit values or the like event occurs or in the case where the fire is taking place with the alarm lamp 46 (see FIG. 7) being lit.

In that case, the slope compensating value C1 is held at the value validated immediately before occurrence of the fire or fault state. Upon restoration of the ordinary state, the compensation is performed with the value held at the time point immediately before the restoration. Subsequently, when the normal state has continued for the update time period a, the slope compensating value C1 is updated.

The slope compensating value C1 makes disappearance when the control unit 20A is reset and thus the compensation is not carried out (the slope compensating value is not written in the EEPROM) until the update time period at has elapsed.

As will now be appreciated, when the light emitting element 11 and the light receiving element 12 of the smoke sensor 10 have been contaminated to such extent that the zero-density detection value VN changes from the initial zero-density detection value VNO, the compensation arithmetic module 28 sets the slope compensating value C1 and the fine correcting value C2 for correctively increasing the detection level Vd.

The smoke density arithmetic module 23A converts the value obtained by subtracting the initial zero-density detection value VNO from the compensated detection level Vdc into the smoke density value VKe, which is then sent to the receiver equipment of the center station as the analog data signal E via the transmission circuit 24.

Thus, with the receiver equipment 30 installed at the center station, the smoke density can constantly be detected discriminatively with high reliability on the basis of the analog data signal E representing the smoke density value VKe with enhanced accuracy even in the state where the smoke sensor 10 is contaminated.

Embodiment 2

In the case of the photoelectric smoke detecting apparatus according to the first embodiment of the invention, the compensation arithmetic module 28 is designed or programmed to arithmetically determine the compensating value for increasing the value of the detection level Vd on the basis of the change ratio ΔVN of the zero-density detection value VN so that the characteristic function Yd after contamination may coincide with the initial characteristic function YO. However, the compensation arithmetic module 28 may alternatively be designed or programmed to arithmetically determine a compensating value for decreasing the slope of the characteristic function for conversion of the detection value to the smoke density value VKe.

In that case, the compensation arithmetic module 28 is designed or programmed to arithmetically determine the compensating value C for compensatively correcting the slope of the characteristic function employed for converting the detection level Vd to the smoke density value VKe to be smaller than the initial slope AO in dependence on the increase of the change ratio ΔVN.

Further, in addition to the correction of the slope of the characteristic function in dependence on the change ratio ΔVN, the compensation arithmetic module 28 adds or subtracts through translation the change quantity of the zero-density detection value VN so that the characteristic function after compensation is compatible with the detection level Vd after contamination.

Furthermore, in conjunction with the photoelectric smoke detecting apparatus according to the first embodiment, description has been made exemplarily on the assumption that compensation for the change of the detection level Vd is performed after contamination of the smoke sensor with a white material (see FIG. 2). However, such compensation procedure can equally be applied to the compensation for the change oft he detection level Vd after contamination of the smoke sensor with a black material (see FIG. 13). In this case, the reliability of smoke and fire detection can equally be enhanced significantly.

Many features and advantages of the present invention are apparent from the detailed description and thus it is intended by the appended claims to cover all such features and advantages of the apparatus which fall within the true spirit and scope of the invention. Further, since numerous modifications and combinations will readily occur to those skilled in the art, it is not intended to limit the invention to the exact construction and operation illustrated and described.

By way of example, the foregoing description of the illustrated embodiments of the invention has been directed to the so-called analog type smoke/fire detecting apparatus or system in which the analog data signal E is generated to be sent to the center station through the medium of the transmission circuit 24. However, such arrangement may equally be adopted in which the smoke density value VKe is directly made use of for discriminatively deciding the occurrence of fire event and the result of the decision is sent to the center or monitor station through the transmission circuit 24.

Thus, many modifications, variations and equivalents of the present invention are possible in the light of the foregoing description. It is therefore to be understood that within the scope of the appended claims, the invention may be practiced otherwise than as specifically described.

What is claimed is:

1. A photoelectric smoke detection apparatus comprising:

a smoke sensor comprising a labyrinth inner wall, a chamber enclosed by said labyrinth inner wall, a light emitting element disposed within said labyrinth inner wall and operable to emit light and a light receiving element disposed within said labyrinth inner wall so as to receive at least a portion of the light and operable to output a detection signal indicative of a detection value corresponding to a smoke density prevailing within said chamber enclosed by said labyrinth inner wall; and a controller operable to output a smoke density value, as analog data, corresponding to the smoke density prevailing within said chamber, said controller comprising a smoke density arithmetic module operable to convert the detection value to a first smoke density value via a characteristic function located therein, a zero-density detection value storage unit operable to store a zero-density detection value that corresponds to zero smoke density prevailing within said chamber, a change ratio arithmetic module operable to arithmetically determine a ratio of change representing a change of the zero-density detection value and a compensation arithmetic module operable to provide a compensating value based on the ratio of change to said smoke density arithmetic module, wherein said smoke density arithmetic module is further operable to change the characteristic function, based on the compensating value, such that said smoke density arithmetic module is operable to convert the detection value into the smoke density value.

2. The detection apparatus of claim 1, wherein the ratio of change comprises a ratio of the zero-density detection value to an initial value, and wherein the compensating value comprises a value such that said smoke density arithmetic module is operable to correctively increase the zero-density detection value when the absolute value of the ratio of change is not a value 1.

3. The detection apparatus of claim 2, wherein said smoke density arithmetic module is operable to convert the detection value into the smoke density value by adding a quantity of change to, or subtracting a quantity of change from, the zero-density detection value.

4. The detection apparatus of claim 1, wherein the ratio of change comprises a ratio of an absolute value, of a change in quantity between the zero-density detection value and an initial zero-density detection value, to the initial zero-density detection value, and wherein the compensating value comprises a value such that said smoke density arithmetic module is operable to correctively increase the zero-density detection value based on the ratio of change.

5. The detection apparatus of claim 1, wherein the ratio of change comprises a ratio of the zero-density detection value to an initial value, and wherein said compensation arithmetic module is further operable to provide a slope compensating value to said smoke density arithmetic module when the ratio of change is not a value 1.

6. The detection apparatus of claim 5, wherein said smoke density arithmetic module is operable to decrease a slope of the characteristic function, based on the slope compensating value, and is operable to subsequently add the compensation value to, or subtract the compensation value from, the zero-density detection value.

7. The detection apparatus of claim 1, wherein the ratio of change comprises a ratio of an absolute value, of a change in quantity between the zero-density detection value and an initial zero-density detection value, to the initial zero-density detection value, and wherein said compensation arithmetic module is further operable to provide a slope compensating value that is based on the ratio of change, to said smoke density arithmetic module, wherein said smoke density arithmetic module is operable to decrease a slope of the characteristic function, based on the slope compensating value.

8. The detection apparatus of claim 1, wherein said control means further comprises an analog-to-digital converter for converting the detection value to digital data, and wherein said smoke density arithmetic module is further operable to convert the digital data to the smoke density value.

9. The detection apparatus of claim 1, wherein said compensation arithmetic module comprises a compensation range discriminator that is operable to determine whether the ratio of change is within a predetermined range for compensation and to generate fault information when the ratio of change is not within the predetermined range.

10. The detection apparatus of claim 9, wherein the ratio of change is based on an average value of a plurality of zero-density detection values determined over a predetermined time duration, when the ratio of change is within the predetermined range for the predetermined time duration.

11. The detection apparatus of claim 1, wherein said compensation arithmetic module comprises a compensating value setting module that is operable to fixedly place therein a compensating value corresponding to the ratio of change.

12. The detection apparatus of claim 11, wherein said compensation arithmetic module further comprises a correcting value setter that is operable to change the compensating value based on the zero-density detection value.

13. The detection apparatus of claim 12, wherein said correcting value setter comprises a correcting value storage that is operable to store the correcting value, and wherein said correcting value setter is operable to alter the correcting value via an external instruction.

14. A detection apparatus comprising:

an emitting element;

a receiving element disposed so as to receive at least a portion of an emission from said emitting element and operable to output a detection signal indicative of a detection value corresponding to a parameter prevailing between said emitting element and said receiving element; and a controller operable to output a determined value corresponding to the parameter, said controller comprising a parameter arithmetic module operable to convert the detection value to a parameter value, an initial detection value storage unit operable to store an initial detection value, a change ratio arithmetic module operable to arithmetically determine a ratio of change representing a change of the parameter based on the detection value and the initial detection value and a compensation arithmetic module operable to provide a compensating value based on the ratio of change to the parameter arithmetic module, wherein said parameter arithmetic module is further operable to change the parameter value, based on the compensating value, into the determined value.

15. The detection apparatus of claim 14, wherein the ratio of change comprises a ratio of the detection value to the initial detection value, and wherein said compensation arithmetic module is further operable to correctively increase the detection value when the absolute value of the ratio of change is not equal to a value 1.

16. The detection apparatus of claim 14, wherein the ratio of change comprises a ratio of an absolute value, of a difference of the detection value and the initial detection value, divided by the initial detection value, and wherein said compensation arithmetic module is further operable to correctively increase the detection value based on an increase of the ratio of change.

17. The detection apparatus of claim 14, wherein the ratio of change comprises a ratio of the detection value to the initial detection value.

18. The detection apparatus of claim 14, the ratio of change comprises a ratio of an absolute value, of a difference of the detection value and the initial detection value, divided by the initial detection value.

19. The detection apparatus of claim 14, wherein the detection value is analog data, wherein said control means further comprises an analog-to-digital converter that is operable to convert the detection value to digital data, and wherein said parameter arithmetic module is further operable to convert the digital data to the parameter value.

20. The detection apparatus of claim 14, wherein said compensation arithmetic module comprises a compensation range discriminator that is operable to determine whether the ratio of change is within a predetermined range for compensation and to generate fault information when the ratio of change is not within the predetermined range.

21. The detection apparatus of claim 14, wherein said compensation arithmetic module comprises a compensating value setting module that is operable to fixedly place therein a compensating value corresponding to the ratio of change.

* * * * *